US010697594B1

(12) United States Patent
Yang

(10) Patent No.: US 10,697,594 B1
(45) Date of Patent: Jun. 30, 2020

(54) LED LIGHT

(71) Applicant: Nathan Yang, Surrey (CA)

(72) Inventor: Nathan Yang, Surrey (CA)

( * ) Notice: Subject to any disclaimer, the term of this patent is extended or adjusted under 35 U.S.C. 154(b) by 0 days.

(21) Appl. No.: 16/825,278

(22) Filed: Mar. 20, 2020

Related U.S. Application Data

(63) Continuation-in-part of application No. 16/724,342, filed on Dec. 22, 2019.

(51) Int. Cl.

| | |
|---|---|
| ***F21K 9/275*** | (2016.01) |
| ***F21V 19/00*** | (2006.01) |
| ***F21V 19/02*** | (2006.01) |
| ***F21V 23/00*** | (2015.01) |
| *F21Y 115/10* | (2016.01) |
| *F21Y 103/00* | (2016.01) |

(52) U.S. Cl.
CPC ..... *F21K 9/275* (2016.08); *F21V 19/008* (2013.01); *F21V 19/02* (2013.01); *F21V 23/002* (2013.01); *F21Y 2103/00* (2013.01); *F21Y 2115/10* (2016.08)

(58) Field of Classification Search
CPC ..... F21K 9/275; F21V 19/02; F21V 23/002; F21V 19/008; F21Y 2115/10; F21Y 2103/00
See application file for complete search history.

(56) References Cited

U.S. PATENT DOCUMENTS

| | | | | |
|---|---|---|---|---|
| 3,144,534 | A * | 8/1964 | Baumbach | H01H 85/055 337/164 |
| 3,192,379 | A * | 6/1965 | De Garmo | F21V 29/74 362/267 |
| 2012/0212951 | A1* | 8/2012 | Lai | H05B 45/00 362/218 |
| 2016/0186934 | A1* | 6/2016 | Harbers | F21V 14/08 362/84 |
| 2016/0219666 | A1* | 7/2016 | Xiong | F21V 15/015 |
| 2016/0219672 | A1* | 7/2016 | Liu | F21K 9/272 |
| 2018/0259135 | A1* | 9/2018 | Xiong | F21V 23/003 |
| 2019/0017661 | A1* | 1/2019 | Xiong | F21V 25/02 |
| 2019/0032864 | A1* | 1/2019 | Xiong | F21V 3/061 |
| 2019/0186699 | A1* | 6/2019 | Xiong | H05B 45/50 |

* cited by examiner

*Primary Examiner* — Isiaka O Akanbi
*Assistant Examiner* — Glenn D Zimmerman
(74) *Attorney, Agent, or Firm* — Gulf Coast Intellectual Property Group

(57) ABSTRACT

A led light that includes a rigid led filament wherein the led filament can be positionally adjusted. The LED light includes a housing having an outer tube and an inner tube with a void therebetween. The inner tube has an interior volume wherein disposed within the interior volume is a filament housing. The filament housing includes an interior volume and is configured to have suspendedly mounted therein a led filament. A pair of filament housing support members are located at each end of the housing in the interior volume thereof and are operably coupled to the filament housing. A conducting wire is movably journaled through the filament housing support members and into the interior volume of the filament housing so as to electrically couple to the led filament. The conducting wire includes at least one integrally formed spring so as to facilitate tension control of the conducting wire.

14 Claims, 3 Drawing Sheets

LED LIGHT

CROSS REFERENCE TO RELATED APPLICATIONS

This application is a continuation-in-part of U.S. patent application Ser. No. 16/724,342 filed, Dec. 22, 2019, entitled, LED Light, which is hereby incorporated for reference.

FIELD OF THE INVENTION

The present invention relates generally to more specifically but not by way of limitation, a led light tube that includes a structure having an outer tube and an inner tube having a centrally located rigid LED filament wherein the LED filament is operably coupled to conducting wires having springs that facilitate adjustment of the location of the LED filament.

BACKGROUND

LED lights and lighting apparatus are known in the art. Over the last decade the acquisition cost of led lights has dramatically decreased. The lower cost and other benefits of led lights such as but not limited to lower power consumption have led to the commercial proliferation of many types of LED lights.

While LED lights are numerous there are still improvements that can be made to increase the benefits and operational efficiency of the LED lights. One such area is temperature control. Another parameter is adjustability. During the manufacturing process or use of a light it can be necessary to adjust the position of the LED filament but conventional designs make this difficult or impossible to execute. The ability to make adjustments to components such as but not limited to filaments can be advantageous.

Accordingly, it is intended within the scope of the present invention to provide a LED light tube that includes a centrally located LED filament wherein the LED filament is operably coupled to conducting wires that are configured to provide adjustment of the location of the LED filament.

SUMMARY OF THE INVENTION

It is the object of the present invention to provide a LED light tube that includes a housing wherein the housing is manufactured from glass and includes an outer tube and an inner tube.

Another object of the present invention is to provide a LED light tube configured to have an adjustable LED filament wherein the present invention includes a rigid LED filament centrally disposed within the interior volume of the inner tube in a glass filament compartment.

A further object of the present invention is to provide a LED light tube wherein the rigid LED filament is operably coupled to conducting wires.

Still another object of the present invention is to provide a LED light tube configured to have an adjustable led filament wherein the conducting wires include springs integrally formed therewith.

An additional object of the present invention is to provide a LED light tube wherein the springs formed in the conducting wires are operable to control the tension of the conducting wire and additionally provide positional adjustment of the LED filament within the glass filament compartment.

Yet a further object of the present invention is to provide a LED light tube configured to have an adjustable led filament wherein the LED light tube of the present invention utilizes DC current having a constant voltage topology.

Another object of the present invention is to provide a LED light tube wherein the conducting wires can be configured to extend out from either one end of the tube or opposing ends of the tube.

Still a further object of the present invention is to provide a LED light tube configured to have an adjustable LED filament wherein the housing can be provided in alternate lengths.

Yet another object of the present invention is to provide a LED light tube wherein the housing of the present invention can be configured to be operably coupled to additional housings and as such provide the formation of a longer continuous lighting element.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
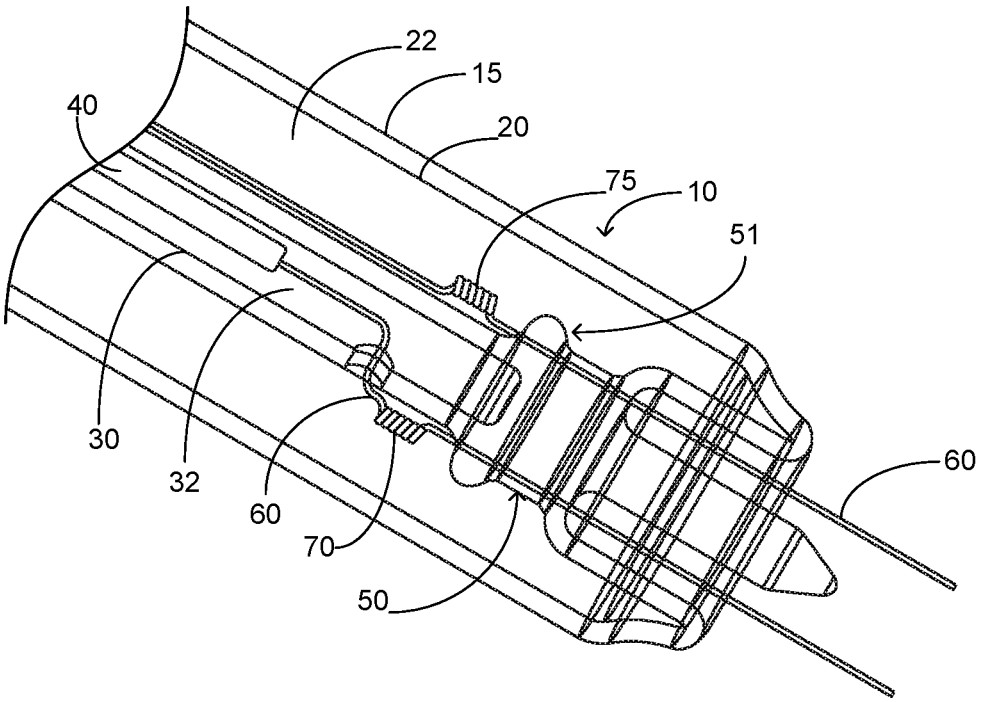
FIG. 1 is a detailed end view of the present invention.

Referring now to the drawings submitted herewith, wherein various elements depicted therein are not necessarily drawn to scale and wherein through the views and figures like elements are referenced with identical reference numerals, there is illustrated a LED light 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to Figures herein, the LED light 100 includes a housing 10. The housing 10 is manufactured from a clear rigid material such as but not limited to glass. In a preferred embodiment the housing 10 is elongated and tubular in shape. While a preferred embodiment is illustrated herein, it is contemplated within the scope of the present invention that the housing 10 could be provided in alternate shapes and sizes. The housing 10 is manufactured from an outer tube 15 and inner tube 20 that are operably coupled utilizing suitable manufacturing techniques. A void 17 is present intermediate the outer tube 15 and inner tube 20. The outer tube 15 is manufactured having suitable durability to act as the exterior case for the LED light 100. The inner tube 20 has an interior volume 22 is of suitable size to contain additional elements of the LED light 100 that are further discussed herein.

Secured within the interior volume 22 is a filament housing 30. The filament housing 30 is manufactured from a clear rigid material such as but not limited to glass. The filament housing 30 is tubular in form and has an interior volume 32 configured to retain a led filament 40 therein. The filament housing 30 extends between the first end 8 and second end 9 of the housing 10 being substantially the length thereof. The filament housing 30 includes a first end 31 and second end 33 wherein the first end 31 and second end 33 are structurally coupled with the filament housing support member 50. The filament housing support member 50 is formed from a suitable material such as but not limited to glass in the interior volume 22 of the inner tube 20. The filament housing support member 50 is integrally formed proximate the first end 8 and second end 9 utilizing suitable techniques. The filament housing support member 50 includes end 51 that is annular in shape and is operable to receive an end of the filament housing 30. It should be understood within the scope of the present invention that the end 51 could be provided in alternate shapes in order to mateably couple with a filament housing 30 of a similar shape.

The filament housing 30 includes an aperture 35 formed therein. The aperture 35 provides access to the interior volume 32 so as to journal conducting wire 60 therein so as to electrically couple to the LED filament 40. While one aperture 35 is illustrated herein, it should be understood within the scope of the present invention that the filament housing 30 could have more than one aperture 35 depending upon the desired routing/orientation of the conducting wire 60. The conducting wire 60 is manufactured from a suitable conductive material such as but not limited to metal. The conducting wire 60 includes a positive current portion 61 and negative current portion 62 providing the required power to operate the LED filament 40. The conducting wire 60 has integrally formed therewith a first spring 70 and second spring 75. The first spring 70 and second spring 75 are utilized to be able to adjust the tension on the conducting wire 60 so as to adjust the position of the LED filament 40 within the interior volume 32. This ensures the ability to suspend the LED filament 40 within the interior volume 32 of the filament housing 30. A user engages ends 59 and applies the necessary force thereto and coupled with the integrally formed first spring 70 and second spring 75 the tension of the conducting wire 60 can be altered and as such change the position of the LED filament 40 that is suspendedly mounted within the filament housing 30. While a first spring 70 and second spring 75 are illustrated herein, it is contemplated within the scope of the present invention that the led light 100 could employ as few as one spring or more than two springs in order to provide tension adjustability of the conducting wire 60 so as to adjust the position of the led filament 40.

Figure 2:
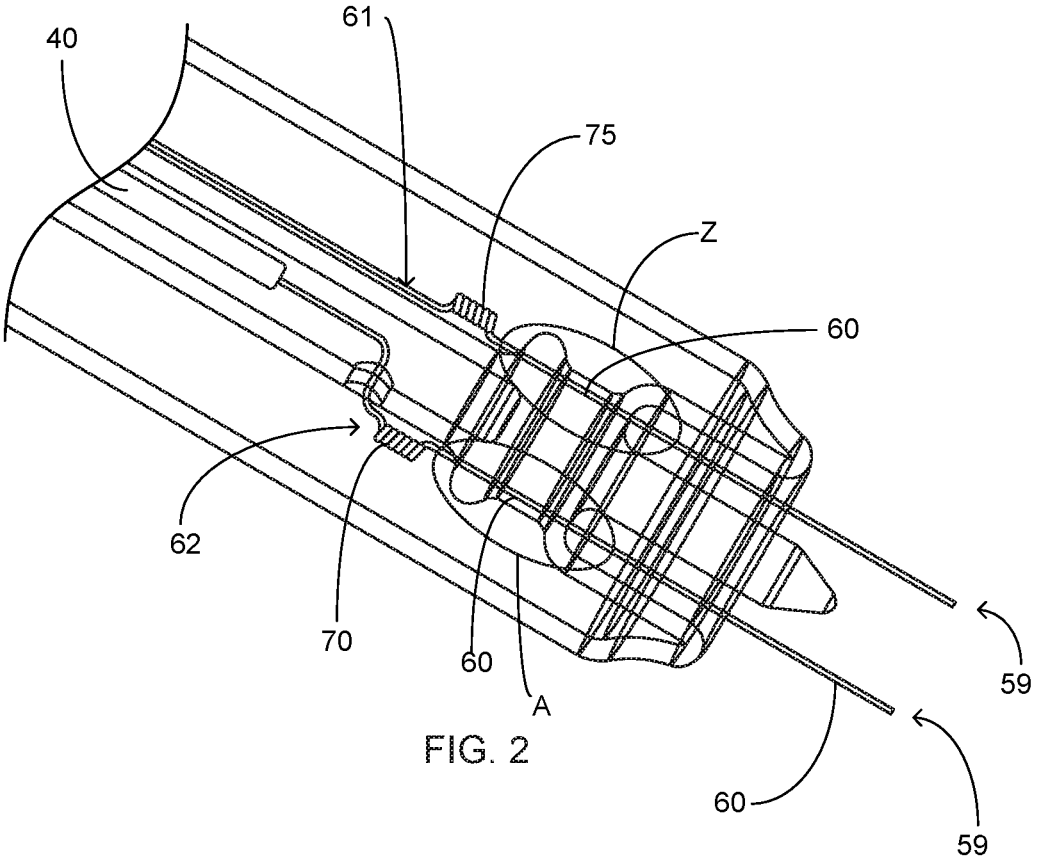
FIG. 2 is another detailed end view of the present invention.
Figure 3:
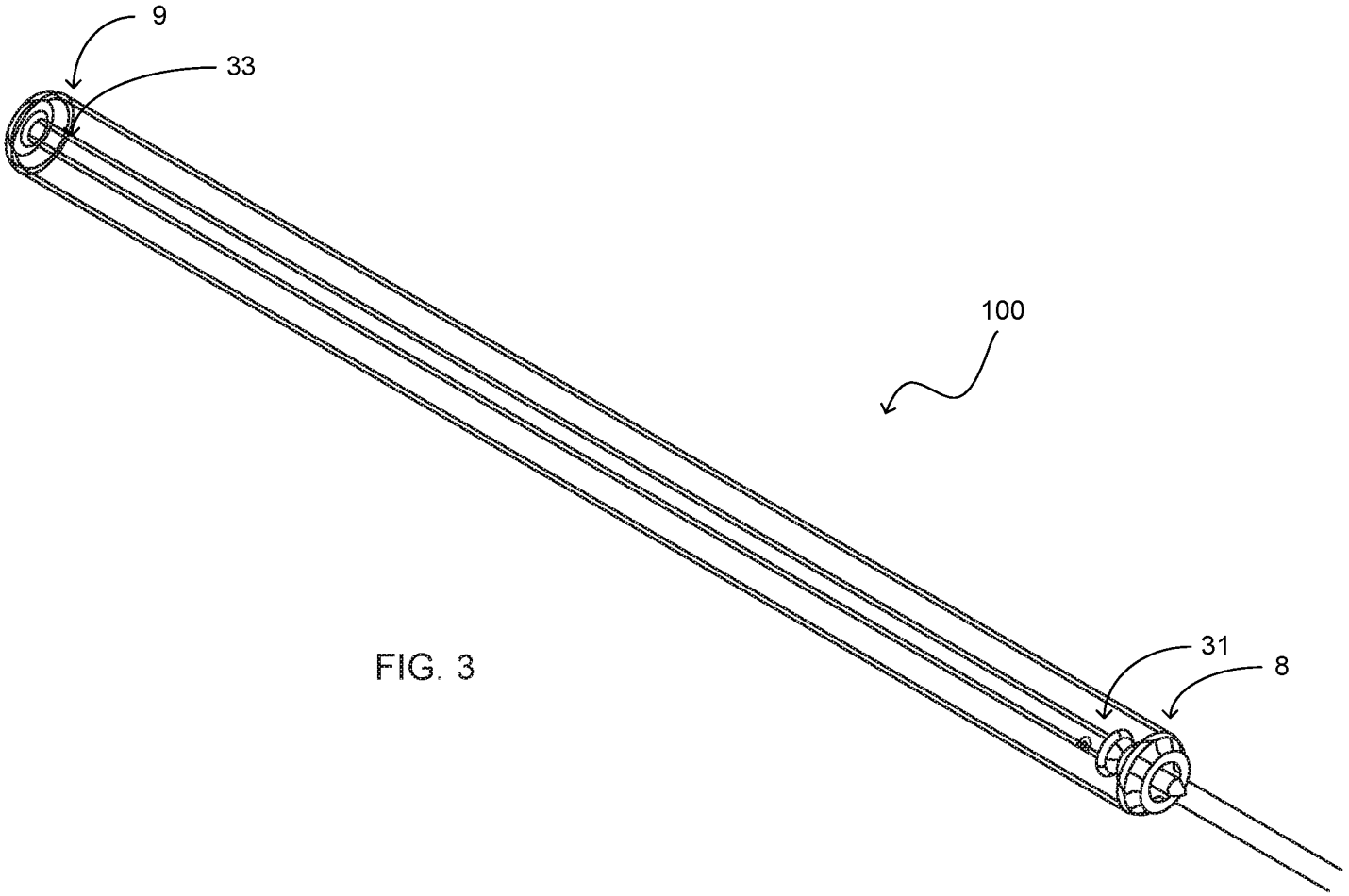
FIG. 3 is a perspective view of an embodiment of the present invention.
Figure 4:
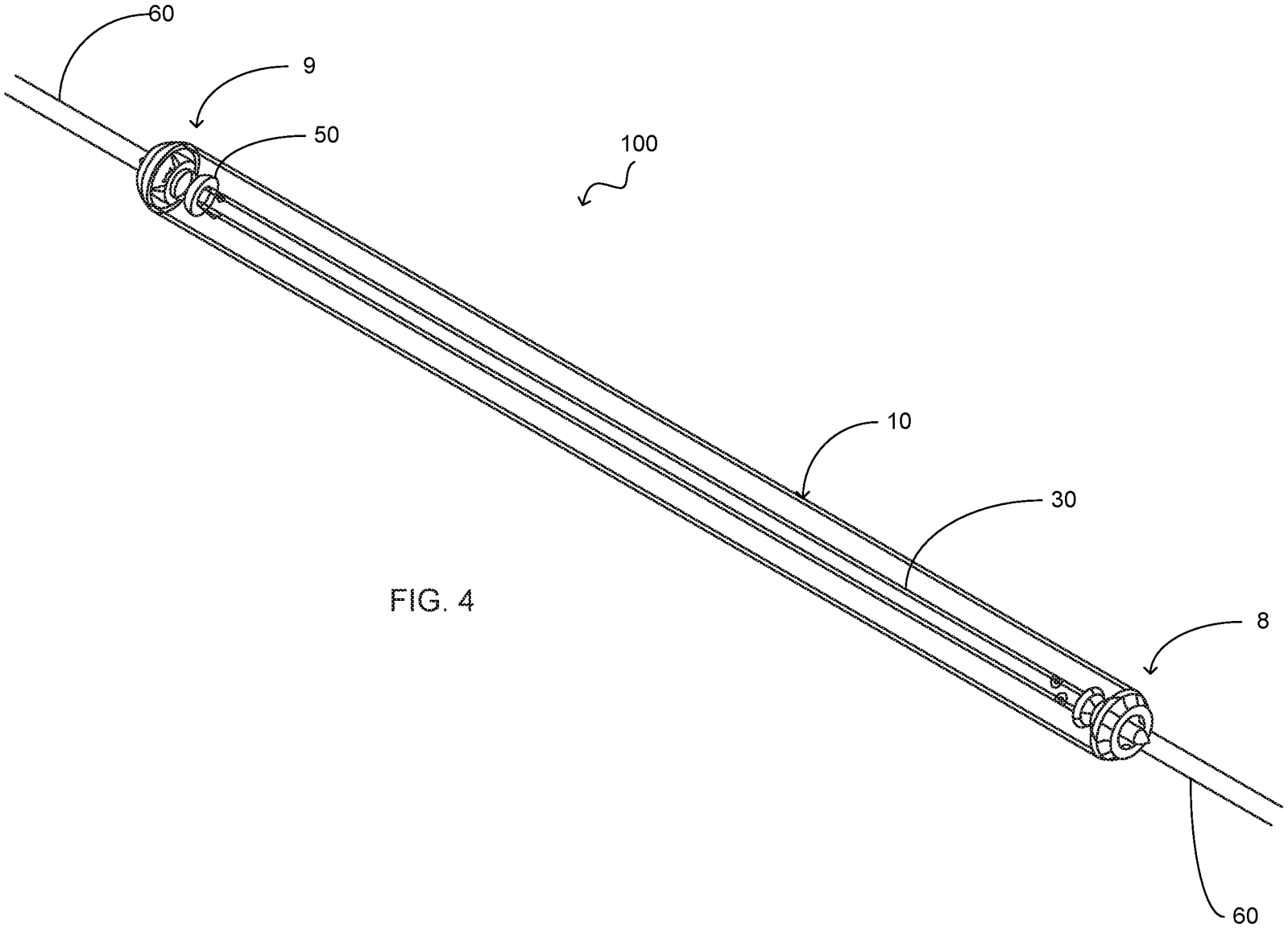
FIG. 4 is a perspective view of another embodiment of the present invention.

Illustrated in FIG. 2 herein, the circles A, Z are provided to show the conducting wire 60 portion that is journaled through the filament housing support member 50. The circles A, Z are not part of the structure of the LED light 100 and are provided to illustrate the portion of the conducting wire 60 that is slidably journaled through the filament housing support member 50. It should be understood within the scope of the present invention that the first end 8 and second end 9 could be configured in alternate manners so as to enable operable coupling within various light fixtures as well as be operably coupled with additional led lights 100 of the embodiment illustrated herein to form a longer continuous lighting element. As is illustrated herein in FIGS. 3 and 4, the led light 100 could be configured to have the conducting wire 60 egress from the first end 8 or be configured to egress from both the first end 8 and second end 9.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A LED light comprising:

a housing, said housing having an outer tube and an inner tube, said inner tube having an interior volume, said housing having a first end and a second end;

a filament housing, said filament housing being located within the interior volume of said inner tube, said filament housing being substantially the length of said housing, said filament housing having an interior volume, said filament housing having a LED filament disposed within the interior volume thereof;

a conducting wire, said conducting wire being electrically coupled to said LED filament, said conducting wire having a portion thereof being located externally to said filament housing, said conducting wire having at least one spring, said at least one spring being integrally formed in said conducting wire; and wherein said at least one spring is configured to enable adjustment of tension on said conducting wire so as to adjust a position of the LED filament disposed within the filament housing.

2. The LED light as recited in claim 1, and further including a pair of filament housing support members, said filament housing support members being located at said first end and said second end of said housing, said pair of filament housing support members disposed within the interior volume of said inner tube, said pair of filament housing support members being operably coupled with said filament housing and operable to provide support thereof.

3. The LED light as recited in claim 2, wherein the filament housing has at least one aperture, said at least one aperture configured to have the conducting wire journaled therethrough.

4. The LED light as recited in claim 3, wherein said conducting wire is slidably journaled through at least one of the pair of filament housing support members.

5. The LED light as recited in claim 4, wherein said conducting wire has a portion thereof that is externally located to said housing.

6. The LED light as recited in claim 5, wherein said first end and said second end of said housing are configured to be operably coupled to a light fixture.

7. The LED light as recited in claim 5, wherein said first end and said second end of said housing are configured to be operably coupled to at least one additional LED light.

8. The LED light as recited in claim 5, wherein said housing is manufactured from clear glass.

9. A LED light that is configured so as to enable a user to adjust the position of a LED filament disposed therein wherein the LED light comprises:

a housing, said housing having an outer tube and an inner tube, said housing having a void intermediate said outer tube and said inner tube, said inner tube having an interior volume, said housing having a first end and a second end, said housing being elongated and tubular in shape, said housing being manufactured from glass;

a filament housing, said filament housing having a first end and a second end, said filament housing being tubular and elongated in form, said filament housing being located within the interior volume of said inner tube, said filament housing being substantially the length of said housing, said filament housing having an interior volume, said filament housing having a LED filament suspendedly secured within the interior volume thereof, said filament housing having at least one aperture formed therein providing access to the interior volume thereof;

a first filament housing support member, said first filament housing support member being proximate said first end of said housing, said first filament housing support member being operably coupled to said first end of said filament housing;

a second filament housing support member, said second filament housing support member being proximate said second end of said housing, said second filament housing support member being operably coupled to said second end of said filament housing;

a conducting wire, said conducting wire being electrically coupled to said LED filament, said conducting wire being journaled through said at least one aperture of said filament housing, said conducting wire having a portion thereof being located externally to said filament housing, said conducting wire having at least one spring, said at least one spring being integrally formed in said conducting wire; and wherein said at least one spring is configured to enable adjustment of tension on said conducting wire so as to adjust a position of the LED filament disposed within the filament housing.

10. The LED light as recited in claim 9, wherein said conducting wire has a portion thereof that is externally located to said housing for engagement thereof by a user so as to adjust tension of the conducting wire and location of the LED filament suspendedly secured within the interior volume of the filament housing.

11. The LED light as recited in claim 10, wherein said first end and said second end of said housing are configured to be operably coupled to a light fixture.

12. The LED light as recited in claim 10, wherein said first end and said second end of said housing are configured to be operably coupled to at least one additional LED light.

13. The LED light as recited in claim 10, wherein said conducting wire includes a contiguous portion thereof that is slidably journaled through said first filament housing support member.

14. The LED light as recited in claim 13, wherein said housing is manufactured from clear glass.

* * * * *